United States Patent [19]

Goldstein

[11] Patent Number: 4,657,822

[45] Date of Patent: Apr. 14, 1987

[54] FABRICATION OF HOLLOW, CORED, AND COMPOSITE SHAPED PARTS FROM SELECTED ALLOY POWDERS

[75] Inventor: David Goldstein, Adelphi, Md.

[73] Assignee: The United States of America as represented by the Secretary of the Navy, Washington, D.C.

[21] Appl. No.: 887,407

[22] Filed: Jul. 2, 1986

[51] Int. Cl.[4] ..... B22F 3/00

[52] U.S. Cl. ..... 428/552; 75/243; 75/246; 419/5; 419/8; 419/11; 419/28; 419/25; 419/66; 419/68; 428/36; 428/408

[58] Field of Search ..... 419/5, 8, 11, 28, 25, 419/66, 68; 75/243, 246; 428/552, 408, 36

[56] References Cited

U.S. PATENT DOCUMENTS 3,535,093 10/1970 Sara ..... 419/11

3,708,282 1/1973 Burr et al. ..... 419/11

4,368,074 1/1983 Otto et al. ..... 419/51

4,423,119 12/1983 Brown et al. ..... 428/558

4,568,516 2/1986 Adlerborn et al. ..... 419/26

*Primary Examiner*—Stephen J. Lechert, Jr.

*Attorney, Agent, or Firm*—Kenneth E. Walden; Frederick A. Wein; Roger D. Johnson

[57] ABSTRACT

Alloy powder is packed into a mold which comprises a complex-shaped solid graphite inner core and a similarly complex-shaped thin glass outer wall. The mold is evacuated, sealed, and then heated to the alloy sintering temperature, the glass softens and applies an isostatic pressure on the alloy as the alloy particles consolidate. After the consolidation step, the mold and its contents are cooled and the glass and graphite materials are removed from the alloy object. This method is particularly useful for preparing complex fittings of Nitinol shape memory alloys.

12 Claims, 6 Drawing Figures

FABRICATION OF HOLLOW, CORED, AND COMPOSITE SHAPED PARTS FROM SELECTED ALLOY POWDERS

BACKGROUND OF THE INVENTION

This invention relates to powder metallurgy and more particulary to the consolidation of metal powders into hollow, cored, and composite shaped parts of nearly solid metals.

Hundreds of thousands of straight tubular fittings made of the Nitinol class of shape change alloys have been used in pressurized and unpressurized pipe and tubing systems in ships and aircraft. These fittings can be connected without expensive welding procedures. However, straight tubular fittings make up only a small fraction of the tubular fittings in these systems. Considerably greater savings can be realized if the more complex fittings, such as tees, ells, crosses, and wyes, can be economically made of the Nitinol alloys.

Unfortunately, these complex fittings can not be cast from Nitinol alloys and machining such shapes from solid Nitinol metal alloy is prohibitively expensive. Nor can state of the art powder metallurgy techniques be used to produce these complex fittings from the Nitinol alloys. The "hot isostatic pressing" (HIP) process requires that the alloy powder be sealed in expensive welded metal cans of the desired shape and placed in special, very expensive chambers capable of applying high temperature and pressure at the same time. Even for simple forms this is an extremely expensive procedure. Another common procedure is called the CIP-sinter process in which the alloy powders are compacted at ambient temperature and then vacuum sintered. This procedure is unsuitable for producing complex fittings of sufficient density.

U.S. Pat. No. 4,227,927 which issued to Herbert L. Block and Jerome Schwertz on Oct. 14, 1980, discloses the CAP® process, "consolidation by atmosphere presure". In this process the metal powder is enclosed within an evacuated glass container, which is then embedded within a free flowing refractory powder, such as graphite, and heated within an air atmosphere furnace. This process, however, has been limited to producing solid objects such as in the tool industry. In order to produce pipes and other hollow objects double walled glass molds would be required. Such molds for complex fittings such as tees, crosses, wyes, etc., would require highly skilled glass blowers and would be prohibitively expensive.

It therefore would be desirable to provide a relatively inexpensive process for producing complex-shaped fittings of Nitinol alloys which have high density and strength.

SUMMARY OF THE INVENTION

Accordingly, an object of this invention is to provide a new powder metallurgy process.

Another object of this invention is to provide a powder metallurgy process for producing complex-shaped Nitinol alloy pipe and tubing fittings.

A further object of this invention is to provide a method of producing high density, high strength, Nitinol alloy pipe and tube fittings.

Yet another object of this invention is to provide a low cost method of producing Nitinol alloy complex-shaped pipe and tubing fittings.

A still further object of this invention is to provide a method of producing hollow Nitinol alloy objects.

These and other objects of this invention are accomplished providing a method of producing a hollow complex fitting from metal and metal alloy powders by loading the powders into a mold having a solid graphite core corresponding to the desired shape and dimensions of the interior of the fitting and an outer wall of a glass which becomes plastic at the sintering temperature, the outer glass wall corresponding to the outer shape of the fitting to be produced. The mold is evacuated, sealed, and packed along with a free flowing refractory powder into an open refractory container and heated at sintering temperature until the metal or alloy has been consolidated as indicated by the outer glass wall ceasing to shrink. The mold is cooled to room temperature during which the outer glass wall breaks away from the consolidated metal and alloy. The solid graphite core is removed by machining to produce the metal or alloy fitting. If the graphite core is left in, the composite object may be used as a structural element.

DETAILED DESCRIPTION OF THE PREFERRED EMBODIMENT

Figure 1:
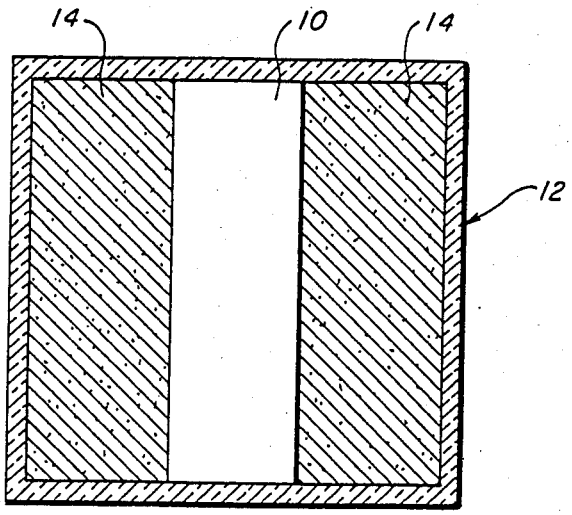
FIG. 1 shows a mold structure for producing a straight fitting.

FIG. 1 shows the mold structure for producing a simple, straight Nitinol alloy fitting according to the process of this invention. A graphite core 10 defines the shape and dimension of the interior of the final fitting. A glass outer wall 12 in the shape of the outer wall of the final Nitinol fitting completes a sealed annular container. The glass outer wall 12 becomes plastic when heated during the sintering step. The space 14 between the graphite core 10 and glass outer wall 12 is filled with powdered Nitinol alloy. Initially a hole is present in the glass wall 12 to allow the loading of the alloy powder into the space 14. The atmosphere in the space 14 is then removed under vacuum and the hole in the glass wall 12 is sealed. The evacuation may be accompanied by mild heating to remove occulded gases from the alloy powder.

The alloy powder is next consolidated using the CAP® process as disclosed in U.S. Pat. No. 4,227,927, entitled "Powder Metallurgy," which issued to Herbert L. Black et al. on Oct. 14, 1980, herein incorporated by reference. Black et al. (in claim 1, col. 4, lines 19–31) summarize the next steps to be taken as follows:

> "(d) placing the mold in an open top refractory container and packing with free flowing refractory powder selected to freely flow at all the temperatures encountered in the process, (e) heating the mold and contents of the mold to a temperature at which sintering of the powder metal takes place and holding at this temperature for a time sufficient to cause substantially complete densification of the powder metal, (f) cooling and removing the mold to recover a dense article, and whereby the glass mold is supported by the free flowing refractory powder as the mold becomes plastic and shrinks in volume as its contents densify."

For greater density a modification of the CAP® process may be used. This procedure is disclosed in U.S. Pat. No. 4,564,501, entitled "Applying Pressure While Article Cools," which issued on Jan. 14, 1986, to David Goldstein, herein incorporated by reference. Goldstein (col. 3, lines 16–29) summarizes this modification to the CAP® process as follows:

"Another application of this slow cooling under pressure modification is to obtain greater density in the nickel-titanium alloys objects than can be obtained by the unmodified CAP® process. The conventional CAP® process is used up to the cooling step. The clay-graphite container (including refractory powder, glass molds, nickel-titanium alloy object) is transferred directly to an insulated container which is placed in a pressure chamber. The insulated container is not air tight so that that pressure in the chamber will be felt on the glass molds. A pressure of 15,000 psi or more, preferably 40,000 psi or more, and more preferably from 100,000 to 200,000 psi is applied during cooling. In this manner, a high density product is achievable without hot working."

Figure 2:
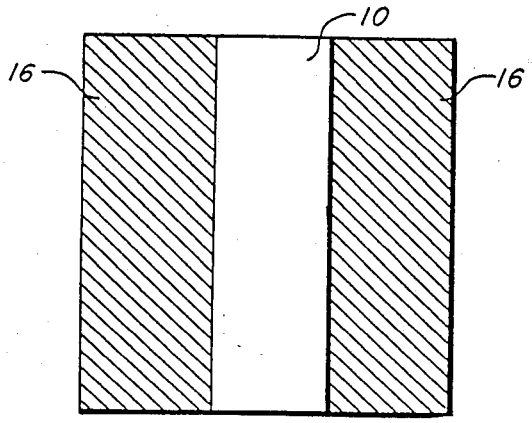
FIG. 2 shows the resulting straight fitting before the graphite core has been removed.
Figure 3:
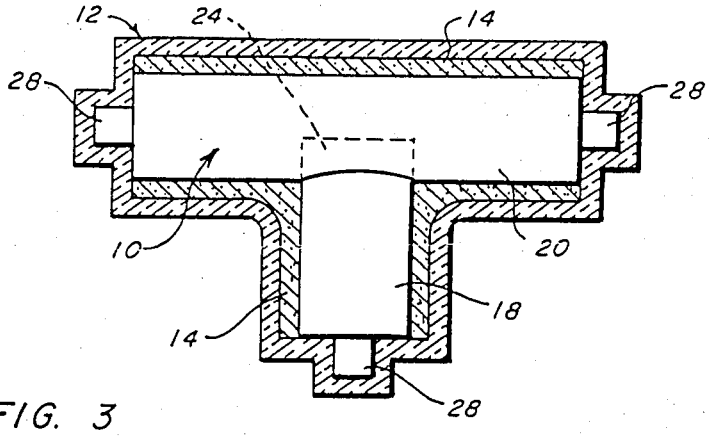
FIG. 3 shows a mold structure for producing a tee fitting.

After the consolidation step, the mold and consolidated alloy material are cooled to room temperature. During the cooling, the glass breaks away leaving the consolidated alloy pipe 16 and the graphite core 10 as shown in FIG. 2. This composite piece might be used as a structural member. Usually, however, the graphite core is machined out to produce a hollow This method is useful in the production of more complex fixtures such as tees, crosses, elbows, and wyes-(Y'S). FIG. 3 shows the mold structure for producing a tee with graphite pieces 18 and 20 connected at joint 24 to produce the graphite core 10 which is centered and positioned within the glass wall structure 12 by positioning and centering bosses 28. The space 14 between the graphite core 10 and glass wall 12 is packed with the alloy powder, evacuated, and sealed in.

Figure 4:
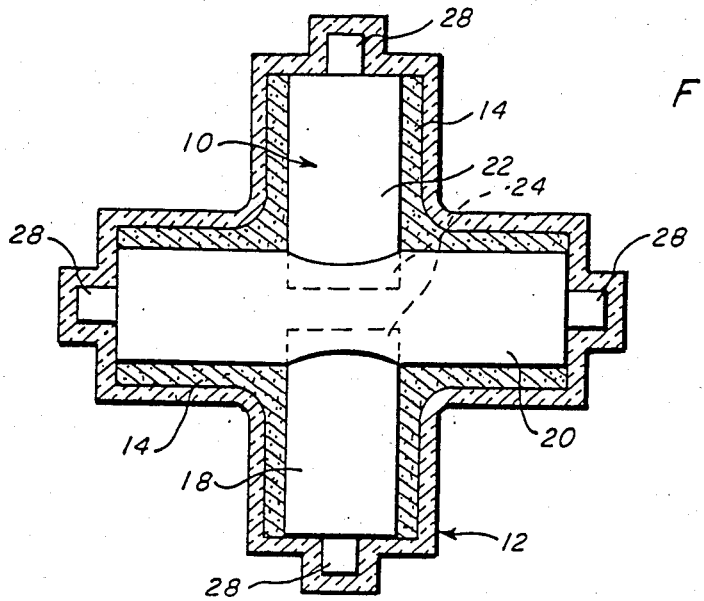
FIG. 4 shows a mold structure for producing a cross fitting.

FIG. 4 shows the mold structure for producing a cross with graphite pieces 18, 20, and 22 connected at joints 24 to form the graphite core 10 which is centered and positioned within the outer glass wall structure 12 by positioning and centering bosses 28. The space 14 between the graphite core 10 and the glass wall 12 is packed with the alloy powder, evacuated, and sealed in.

Figure 5:
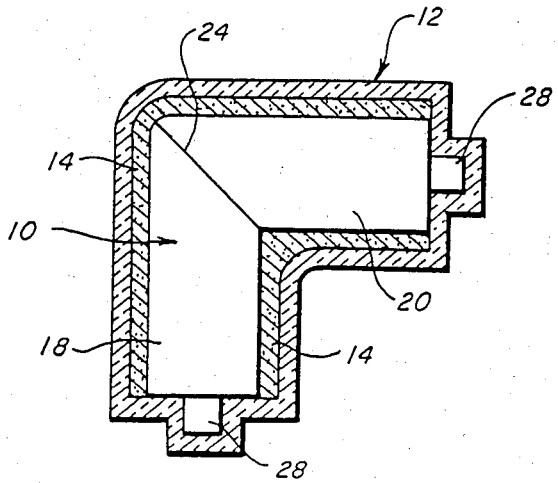
FIG. 5 shows a mold structure for producing an elbow fitting.

FIG. 5 shows the mold structure for producing an elbow with graphite pieces 18 and 20 connected at joint 24 to produce graphite core 10 which is centered and positioned within the outer glass wall structure 12 by positioning bosses 28. In this case graphite cement is used to connect graphite pieces 18 and 20 together at joint 24. The space 14 between the graphite core 10 and the glass wall 12 is packed with the alloy powder, evacuated, and sealed in.

Figure 6:
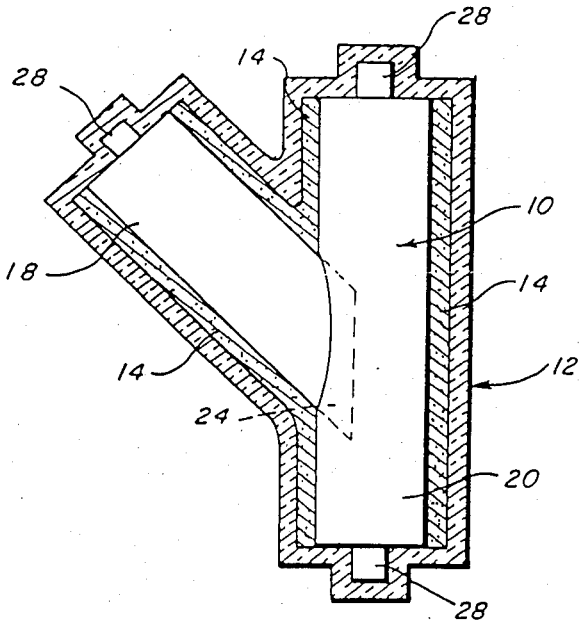
FIG. 6 shows a mold structure for producing a wye fitting.

FIG. 6 shows a mold structure use to produce a typical wye with graphite pieces 18 and 20 connected at joint 24 to product graphite core 10 which is centered and positioned within the outer glass wall structure 12 by positioning bosses 28. The space 14 between the graphite core 10 and the glass wall 12 is packed with alloy powder, evacuated, and sealed in.

In the final product, the shape and dimensions of the hollow interior of the fitting are those of the graphite core 10 used. Although the graphite cores shown in FIGS. 1–6 are made up of cylindrical shapes, other more complex and even irregular-shaped graphite cores may be used. The Nitinol alloys are very hard and extremely difficult to machine. In contrast, the graphite is soft and easy to remove. As a result, a wide range of techniques such as scraping or abrading may be used in addition to conventional techniques such as drilling to remove the graphite.

The shape of the external surface of fitting will be the same as the shape of the glass wall structure 12. Although the glass walls shown in FIGS. 1 and 3–6 are cylindrical or made up of cylindrical shapes, other more complex and even irregular shapes may be used.

The thicknesses of the metal walls 16 of the final fixture will be determined by the initial packing density of the alloy powders, the final density of the alloy structure after the consolidation process, and the initial space 14 between the walls of the glass structure 12 and the graphite core 10. By varying and adjusting these factors, the desired size and shape of fitting may be produced.

Examples of alloys for which the method of the present invention is useful include the shape memory alloys of nickel and titanium (NITINOL). Fittings made of these alloys are useful in providing weldless connections for pressurized and unpressurized liquid and gas systems. However, as these Nitinol alloys are not castable and are extremely difficult to machine, the present method is very valuable.

Specific examples of Nitinol alloys which may be used in the present method to produce fittings include those containing from 38 to 47, and preferably from 42 to 46 weight percent of titanium, from zero to about 6 weight percent of an additive metal which is cobalt, iron, or mixtures thereof, with the remainder of the alloy being nickel. When the additive metal is omitted (zero weight percent) the alloy is binary (Ti-Ni). As is well known in the art, from more than zero to about 6 weight percent of additive metal (Co, Fe, or mixtures thereof) may be added to change the transition temperature range (TTR) of the shape memory alloy. Small amounts (up to a few percent) of other elements may be added to these alloys provided that they do not interfere with the shape memory effect.

The density of the consolidated alloy material in the fittings must be at least 95.5 percent of the theoretical density. Higher densities are preferred and may be necessary in certain applications such as in high pressure gas systems. A number of factors affect the density of Nitinol fittings produced by the method of this invention. Finer alloy powder will result in a denser product. Alloy powders of −60 mesh are preferred, with −100 mesh being more preferred. A practical limitation on the alloy powder size is cost; for example, −300 mesh Nitinol powders are extremely expensive and therefore not practical for this process. A common technique for increasing density in powder metallurgy is to mix small particles in with the larger particles; the small particles fill in holes left between the large particles. Finally, it should be noted while the CAP® process of U.S. Pat. No. 4,227,927 is suitable for many of the applications of the method of the present invention, the modified process of U.S. Pat. No. 4,564,501 produces denser products. This is particularly true when very high pressures are applied during the slow cooling step.

Obviously many modifications and variations of this invention are possible in light of the above teachings. It is therefore to be understood that within the scope of the appended claims the invention may be practiced otherwise than as specifically described.

What is claimed is:

1. A method for producing objects of shape memory alloys comprising the following steps in order:

(a) placing unconsolidated powder alloy comprising from 38 to 47 weight percent of titanium, from zero to 6 weight percent of an additive metal selected from the group consisting of cobalt, iron, and mixtures thereof with the remainder of the alloy being essentially nickel in a mold comprising a solid graphite core, a sealable glass outer wall which becomes plastic when heated, and space provided between the solid graphite core and the glass wall for the alloy powder;

(b) evacuating the atmosphere from the alloy powder filled mold;

(c) sealing the mold;

(d) placing the mold in an open top refractory container and packing with free flowing refractory powder selected to freely flow at all the temperatures in the process;

(e) heating the mold and the alloy contents of the mold to a temperature at which sintering of the alloy powder takes place and holding at this temperature for a time sufficient to cause substantially complete densification of the powder alloy, during which step the mold is supported by the free flowing refractory powder as the glass wall of the mold becomes plastic and shrinks in volume as its alloy contents densify putting pressure against the solid graphite core; and (f) cooling and removing the glass portion of the mold to leave a composite article comprising the consolidated alloy and the graphite core.

2. The method of claim 1 which further comprises after step (e) but before step (f), transferring the open top refractory container, refractory powder, and mold directly into an insulated, refractory lined covered container and then placing the covered container into a pressure chamber and applying an isostatic pressure of 2,000 psi or more to the mold while it slowly cools down.

3. The method of claim 1 which further comprises the following step (g) removing the solid graphite core from the composite object produced in step (f) to produce a hollow shape memory alloy object.

4. The method of claim 3 which further comprises after step (e) but before step (f), transferring the open top refractory container, refractory powder, and mold directly into an insulated refractory lined covered container and then placing the covered container into a pressure chamber and applying an isostatic pressure of 2,000 psi or more to the mold while it slowly cools down.

5. The method of claim 1 wherein the power alloy contains from 42 to 46 weight percent of titanium.

6. The method of claim 1 wherein the powder alloy contains zero percent of the additive metal selected from the group consisting of cobalt, iron, or mixtures thereof.

7. The method of claim 1 wherein the powder alloy contains from more than zero to 6 percent of the additive metal selected from the group consisting of cobalt, iron, and mixtures thereof.

8. A composite object comprising a graphite core and an outer portion of an alloy comprising from 38 to 47 weight percent of titanium, from zero to 6 weight percent of an additive metal selected from the group consisting of cobalt, iron, and mixtures thereof, with the remainder of the alloy being essentially nickel.

9. The composite object of claim 8 wherein the graphite core is solid.

10. The composite object of claim 9 wherein the alloy contains from 42 to 46 weight percent of titanium.

11. The composite object of claim 9 wherein the alloy contains zero percent of the additive metal.

12. The composite object of claim 9 wherein the alloy contains from more than zero to 6 percent of the additive metal.

* * * * *